US007764165B2

(12) United States Patent
Withington et al.

(10) Patent No.: US 7,764,165 B2
(45) Date of Patent: Jul. 27, 2010

(54) LOCATABLE INFORMATION SOUND DEVICE AND METHOD

(75) Inventors: Deborah Jane Withington, Harrogate (GB); James Brendan Keane, Cheshire (GB)

(73) Assignee: Qed Intellectual Property Limited, London (GB)

( * ) Notice: Subject to any disclaimer, the term of this patent is extended or adjusted under 35 U.S.C. 154(b) by 162 days.

(21) Appl. No.: 11/197,748

(22) Filed: Aug. 5, 2005

(65) Prior Publication Data

US 2007/0063822 A1 Mar. 22, 2007

(30) Foreign Application Priority Data

Jul. 26, 2005 (GB) ..... 0515269.9

(51) Int. Cl.
*G08B 3/10* (2006.01)

(52) U.S. Cl. ..... 340/384.4; 340/825.36; 340/825.49; 340/384.7

(58) Field of Classification Search ..... 340/384.4, 340/384.7, 326, 309.15, 825.36, 825.49
See application file for complete search history.

(56) References Cited

U.S. PATENT DOCUMENTS 4,086,589 A * 4/1978 Cieslak et al. ..... 340/384.4
4,952,931 A * 8/1990 Serageldin et al. ..... 340/902
5,266,921 A * 11/1993 Wilson ..... 340/384.5
5,428,988 A * 7/1995 Starkovich ..... 73/40
5,663,714 A * 9/1997 Fray ..... 340/692
5,848,384 A * 12/1998 Hollier et al. ..... 704/231
5,898,363 A * 4/1999 Altilio ..... 340/384.1
5,949,328 A * 9/1999 Latty ..... 340/326
6,097,289 A * 8/2000 Li et al. ..... 340/531
6,201,470 B1 * 3/2001 Withington ..... 340/384.7
2006/0214809 A1 * 9/2006 Sistare ..... 340/628

FOREIGN PATENT DOCUMENTS

EP 1225551 10/1984
EP 0846311 6/1998

OTHER PUBLICATIONS

Withington et al., "Auditory Guidance in a Smoke-filled Tunnel", Ergonomics, Vol. 47, pgs. 1131-1140, Aug. 15, 2004.

* cited by examiner

*Primary Examiner*—Daryl Pope
(74) *Attorney, Agent, or Firm*—Jacobson Holman PLLC

(57) ABSTRACT

A device is described to provide a localisable information signal. The device is adapted to emit sequentially a locating sound signal comprising broad band sound and an information sound signal comprising at least verbal information. A signal generated by such a device, a system incorporating a plurality of such devices, and a method of enabling an individual to orientate in an environment using such a system or signal are also described.

10 Claims, 1 Drawing Sheet

LOCATABLE INFORMATION SOUND DEVICE AND METHOD

Figure 1:
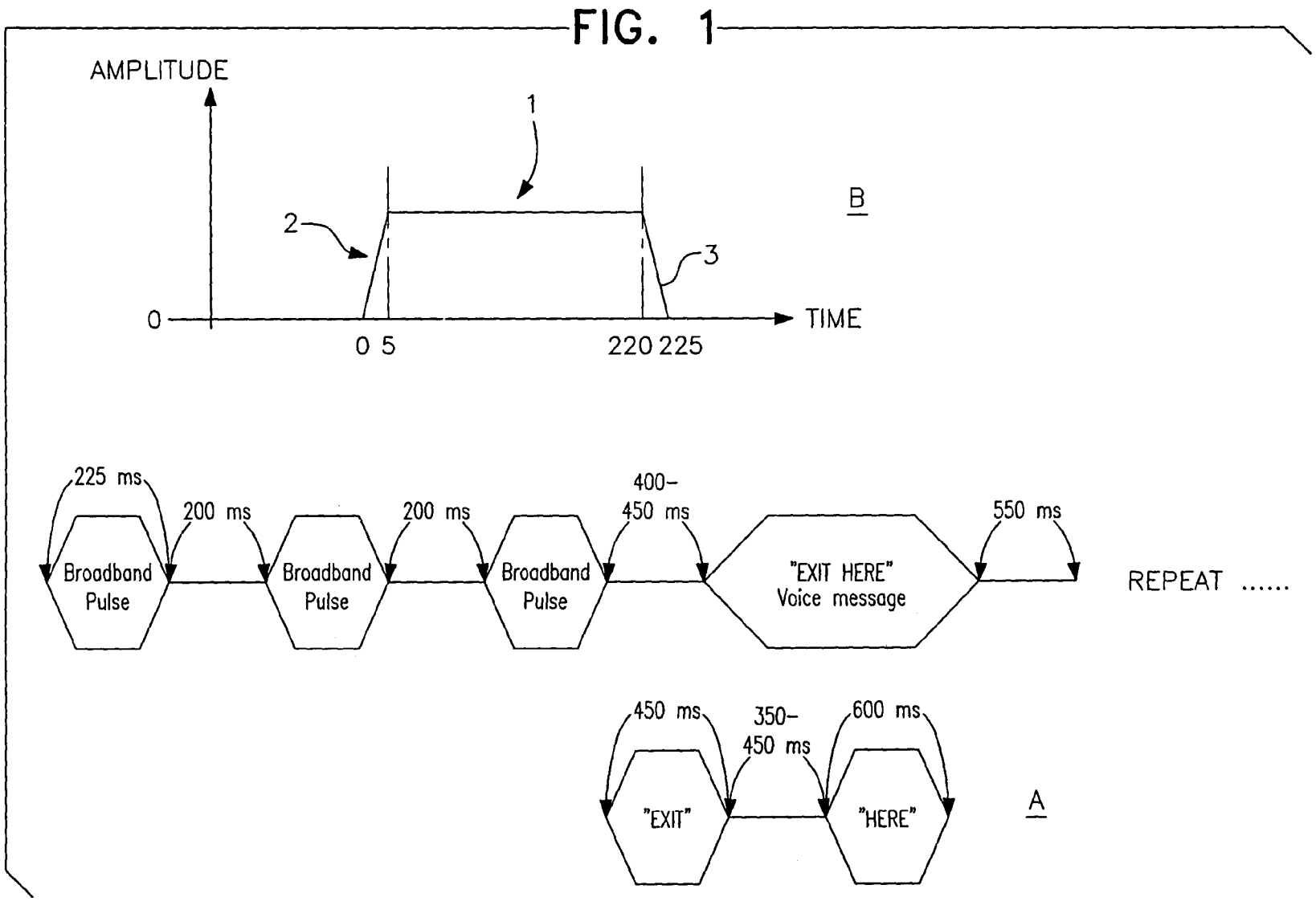

This invention relates to signal patterns for devices to enable the transmission of both verbal information and locatable sound to a person in the vicinity; to locatable information devices generating such a signal; and to a method for the generation of such a signal. The invention is in particular applicable to systems incorporating the signal, device or method for use in, particularly but not exclusively, buildings, domestic or commercial or large transport vehicles such as aircraft, liners or the like, in pedestrian aids such as road crossing devices, and indicating devices such as audible warning devices or sirens, and in particular in relation to the location of emergency exits and the like.

In instances of emergency, or even in instances where it is simply necessary to direct individuals to a predetermined location, audio and/or visual means may be provided in order to alert individuals to a given situation and/or to indicate a direction in which individuals must travel in response to said situation. For example, in the instance where there is danger or hazard because of a domestic or commercial fire or in the instance where there is a leak either chemical or physical, such as in the form as radiation, it may be necessary to firstly alert individuals to the potential danger or hazard and secondly to ensure that the individuals can reach a safe environment.

To this end, domestic dwellings or indeed any of the aforementioned constructions, may be provided with smoke detectors and commercial buildings may be provided with smoke/chemical/radiation detectors and a combination of signs indicating a safe point of exit. Activation of the detectors typically result in an alarm sounding which simply alerts individuals to potential danger and then individuals, either through knowledge of their own domestic environment, or through following a number of signs are expected to find a safe point of exit.

Unfortunately, where there is a fire or a chemical leak or other condition of poor visibility signs can be obscured from view and/or an individual's ability to see such signs can be impaired because of the effects of the smoke/chemical on vision. Even in good visibility signs can be obscured or out of line of sight. It therefore follows that the provision of a conventional alarm with or without signs is an insufficient safeguard to ensure that individuals can exit a building.

It can be seen that it might be desirable if the audible cue could be used to guide an individual around an environment. However the alarms commonly used in emergencies consist typically of a narrow range of frequencies, which are known to be difficult to localize. In any event they are not conventionally placed over doors or other exits.

Accordingly, EP0846311 and EP1225551 and corresponding U.S. Pat. No. 6,201,470, describe the use of broad band sound to enable a user in an environment to locate and orientate himself by means of the sound, in the latter case when delivered in a combination locatable alarm in conjunction with a narrow band sound alert signal (such as a siren or bell).

This prior art makes use of a feature of human sound signal processing, whereby the brain can detect the direction of a sound source to a high degree of accuracy but only when the sound is complex and made up of frequencies with some breadth across at least two particular parts our hearing range. The general underlying theory in the prior art is set out below.

The ability to localize a sound source is an evolutionary prerequisite for survival. For example, when hearing the crack of a twig as a predator approaches, there is simply not time to wait and look around to check where the sound is coming from. To survive we must react instantly, as soon as the audible signal is received. Similarly, for predators, a rustle of leaves may indicate where their potential prey is hiding, and locating that position will determine whether or not they eat on that occasion. It is, therefore, safe to conclude that pinpointing sound is something we do well. In reality we can localize a sound to an accuracy of about five degrees, given the right type of sound. This level of accuracy is less than that for visual spatial acuity, but more than adequate for survival purposes.

There is one particular part of our central nervous system that plays a vital role in the detecting of, and equally importantly, the response to a sound source. This area is part of the mid-brain and is called the superior colliculus (SC). Neurophysiologists studying the properties of neurones in the SC together with psychoacousticians studying human responses to sound have enabled us to understand how the brain processes information relating to a sound source and, importantly, what type of sound is needed for a degree of accuracy to be achieved. The SC responds to novel sensory stimulation and thus, a pulsed sound is most effective at stimulating this region of the brain. It has long been recognised that localizing a sound source requires a vast amount of neural processing. Only certain types of sounds are inherently localizable and what is crucial is that they contain a large spectrum of frequencies, that is broadband sound. Pure tones, simple tone combinations or narrowband noise cannot be localized. To understand why this is the case, the cues given by sound, recognised by the brain, must be considered.

We can hear a vast range of frequencies, from approximately 20 Hz to 20 k Hz, although this range diminishes as we age. There are three main types of information that allow the brain to localize sound. The first two are known as binaural cues because they make use of the fact that we have two ears, separated by the width of our head. A sound that emanates from either side of the mid-line will arrive first at the ear closest to it and will also be loudest at the ear closest to it. At low frequencies (below 1,000 Hz) the brain recognises differences in the time of arrival of the sound between the ears (ITD), and at higher frequencies (above 3,000 Hz) the salient cue is the loudness/intensity difference between the sound at each ear (IID). The use of these two types of cue is known as the 'duplex' theory and was proposed by Lord Raleigh as long ago as 1877.

For single frequencies these cues are, however, spatially ambiguous. The inherent ambiguity has been described as the 'cone of confusion'. This arises from the fact that for any given frequency there are numerous spatial positions that generate identical timing/intensity differences; these can be graphically represented in the form of a cone, the apex of which is at the level of the external ear. The cone of confusion is the main reason for our not being able to localize pure tones.

The final main piece of information processed by the brain regarding sound localization is called the head-related transfer function (HRTF) (for frequencies 5,000 Hz and above). The HRTF refers to the effect the external ear has on sound. As a result of passing over the bumps or convolutions of the pinna, the sound is modified so that some frequencies are attenuated and others are amplified. Although there are certain generalities in the way the sound is modified by the pinnae, the HRTF of any one person is unique to that individual. The role of the HRTF is particularly important when we are trying to determine whether a sound is immediately in front of, or directly behind, us. In this instance the timing and intensity differences are negligible and there is consequently very little information available to the central nervous system on which to base a decision of 'in front' or 'behind'. So, to locate the direction of a sound source, the larger the frequencies content, to overcome the ambiguities inherent to single tones, the better the accuracy.

To that extent, the locatable signal in the prior art needs to be broad band, at least sufficiently so as to have some sufficient breadth both across the frequencies below 1000 Hz, and the frequencies above 3000 Hz and especially also above 5000 Hz, that are necessary for each cue. Where used herein, broad band sound should be interpreted with reference to this requirement.

The prior art devices are successful in that they do allow the source of the emitted broad band sound to be localized by a person in the vicinity of the emitter. It is evident why this might have value in conjunction with an alarm system, where the locatable sound may be used as described in the prior art to identify and/or direct to an exit. However, whilst the localizability of the broad band sound is an inherent property of the sound and of the way the human aural apparatus processes the sound, it is not inherent that the hearer would immediately recognise that such a sound is intended for a specific guidance or like purpose, for example to identify an emergency exit. Such a secondary inference would generally need to be taught, for example by suitable evacuation drills or notices.

It is an object of the invention to mitigate this disadvantage by providing a sound signal and corresponding device and method which is both locatable and informative.

It is a particular preferred object of the invention to provide such a sound signal, device and method which, in that it is both locatable and informative, assists a hearer in the vicinity to orientate with respect to and negotiate a potential hazard, for example but not limited to an emergency evacuation situation from a building, other structure such as a tunnel or the like, or large transport vehicles such as an aircraft, liner or the like in the event of an emergency such as a fire, chemical leak or the like.

According to a first aspect of the invention there is therefore provided a device which is adapted to emit sequentially a locating sound signal comprising broad band sound and an information sound signal comprising at least verbal information.

The said locating sound comprises broad band sound as described hereinbefore in relation to the prior art devices, and to the theory of sound localization set out herein. That is to say, the locating sound will include signal elements having sufficiently breadth both across frequencies below 1,000 Hz and across frequencies above 3,000 Hz and especially also above 5,000 Hz to give the necessary auditory cues. Preferably, the locating sound will include elements spread across a substantial part of both the low and the high frequency ranges so defined within the human hearing range, and will for example be spread across a substantial part of the breadth of the range frequencies between 200 and 1,000 Hz, and between 3,000 and 12,000 Hz, wherein the breadth of the range is considered on a logarithm scale. Most preferably, the locating sound will comprise frequencies spread over a breadth comprising a majority of the human hearing range considered at various ages, again also considered on a logarithmic scale.

It is not necessary for the signal to have the same amplitude, or indeed any amplitude, across the entire breadth so covered. It would be sufficient for example for the breadth of signal to be provided by a plurality of relatively discrete signals spread across the required frequency range. However, some breadth of signal is required both at the lower and the higher frequencies described: a single narrow lower frequency tone and a single narrow higher frequency tone would not readily be localizable.

The information sound signal gives verbal information in some form. That is to say, it is possible for the hearer to derive an information message including one or more words from the sound signal. For most practical applications the information sound signal will comprise direct vocalisation of a verbal information message, typically as one or more spoken words. However the invention includes information sound signals from which verbal information is vocalised in an alternative or more complex manner or otherwise derivable from the sound signal, for example in that the sound signal employs a coding system such as morse.

The information sound signal thus preferably comprises a recorded and/or a synthesised voice. Complex information sound signals in which any spoken words are modulated and/or combined with other signal elements may be employed. Additional non-verbal sound to reinforce the message and/or for other purposes maybe present.

The two signals are sequential, which is to say that they are emitted successfully in discrete bursts. That is to say, a signal cycle comprises a locating sound signal made up of at least one discrete burst of locating sound, followed by a pause, followed by an information sound signal comprising at least one burst of verbal information.

At this point it is worth noting that speech, which encompasses a frequency range that the ear is particularly sensitive to, operates over a narrow frequency range in the region 500-3,000 Hz. Very little of this range is of use for sound localization. There has not been any evolutionary pressure for speech to be localizable as we are usually within visual contact with the person we are talking to.

In accordance with the present invention, a verbal information signal is used instead of a narrow frequency band alarm of the type described in EP1225551, and the two signals are carefully sequentially separated to ensure that the brain is capable of perceiving both the localizable sound and the information conveying sound and process both effectively. This prior art is clear that a narrow band alarm is envisaged in combination with the locating sound. Although the invention is not limited by any theory of operation, it seems that, in part of the reasons set out above provided the two signals are successive and not simultaneous, and are separated by a sufficient discrete interval to allow for separate processing by the brain, the complex speech signal can be isolated and separately processed by the brain with surprising precision without detracting from the ability to locate the locating sound.

The sequential and discrete separation of a locating sound signal and an information sound signal is critical to the success of the invention. Simultaneous or overlapping verbal and locating sounds will tend to interfere with the separate processing of the two signals by the brain, and the effectiveness of both signals will be lost.

For maximum effect the device is preferably adapted to repeat a signal cycle (that is, a cycle comprising a locating sound signal as above described and an information sound signal as above described) successively. Provided the repeat interval is kept sufficiently short, it is found that the individual is able to process both the locating sound and the informational sound in a manner which allows them to be acted upon for practical purposes simultaneously even though it is necessary for the purposes of the invention to maintain the signals discrete and separate.

Preferably, the device is adapted to repeat a full signal cycle with a repeat interval of no more than 60 s, more preferably no more than 20 s, and in particular between 3 and 10 s. Such a relatively short repeat interval is governed by the need to allow sufficient time for meaningful information to be conveyed by the information signal, but nevertheless to ensure that the locating signal is repeated sufficiently frequently that an individual is able to maintain the sense of orientation and direction thereby.

Taken together, the carefully arranged discrete pattern of locating and information signal with intervening pauses and the controlled repeat cycle length mean that it has been surprisingly found that a significant degree of verbal information can be conveyed in a complex signal in conjunction with a locating sound without detracting substantively from the localizibility of the overall complex signal.

Each locating sound signal preferably comprises a plurality of short discrete bursts of locating sound each separated by a short pause. Each locating sound signal preferably comprises a plurality of such locating sound bursts, and for example 3 to 5 such bursts. This is because the locating sound is most effectively localized by the individual when it is novel, rather than when it is continuous. Therefore, a localising sound signal comprising a plurality of closely successive short bursts is more effectively localized. This effect might also contribute to the localizability of the overall complex signal in accordance with the invention, which the user continues to be able to achieve even when verbal information sound signals are contained within the cycle.

Suitably in a locating sound signal cycle a locating sound signal burst is produced, and then after a first intervening delay, another locating sound signal burst is produced and then, after a second intervening delay, another locating sound signal burst is produced.

Preferably the intervening delays each have a duration in the range 5 ms to 500 ms, and in particular 10 to 250 ms. Optimal delay times have found to be of the order of 50 to 200 ms depending on conditions.

Preferably after the final locating signal burst, there is a further signal separation delay, followed by the information sound signal. The signal separation delay may have a duration of 1 ms to 60 s, for example 100 to 1000 ms, and in particular 200 to 500 ms. Optimal delay times will depend on the reverberation environment.

Preferably after the information sound signal there is a further cycle separation delay and then the cycle is repeated. A cycle separation delay may be of similar order to, or slightly longer than, the signal separation delay and may have a duration of 1 ms to 60 s, for example 200 to 1000 ms, and in particular 300 to 700 ms. Optimal delay times will depend on the reverberation environment.

The locating sound may be emitted for an interval between 10 ms to 5 secs and ideally between 10 ms to 500 ms, more preferably between 150 ms and 300 ms or more preferably further still for a duration of approximately 200 to 250 ms.

The locating sound may be ramped so that, for example, a 5 to 10 ms onset time is followed by 150 to 500 ms of sound emission and a 5 to 10 ms offset time. Although we prefer a locating sound having the aforementioned ramped profile obvious alterations may be provided without deviating from the scope of the invention. We have found that ramping, advantageously, avoids a ringing effect.

Selected components of the locating sound may be amplified or attenuated having regard to the properties of a speaker of the device and/or the absorbing properties of the environment in which a listener is located and/or the auditory, either existing or expected, environment of a listener.

The locating sound may comprise bursts of locating noise wherein the interval between each of said bursts successively diminishes and/or the length of each burst of locating noise successively diminishes thus providing for a noise pattern of quickening sound or continuity.

As an example only of locating sound broad band sound in a range between 40 Hz and 20 kHz may be provided although in one embodiment we prefer to use 40 Hz to 16 kHz. However, it is not intended that the invention should be limited to these frequencies which are merely provided by way of exemplification, rather any sound of sufficient complexity which enables localization can be used.

The verbal information sound comprises one or more spoken words. Where the information signal comprises a plurality of such words, each word is preferably transmitted as a discreet signal burst with an intervening delay therebetween. The intervening delay should be sufficient to allow each word to be separately processed by the brain, for example having a duration in the range 50 ms to 5 s, preferably 100 to 500 ms and in particular 350 to 450 secs.

Where the information signal comprises a plurality of words, it is nevertheless desirable that only a few words, for example no more than 5 words, are used first to keep the information message simple and second to ensure that when the complex cycle which is the essential feature of the invention is repeated successively, the locating sound signal element is being emitted sufficiently frequently to maintain the individual's ability to localize the overall signal.

It is the essential feature of the present invention that the device emits a complex signal comprising at least a localizing signal and a verbal information signal. The localizing signal is necessary to ensure that the overall complex signal can be localized fully and effectively. It has been found that provided the careful sequencing of different signals described above is followed, a complex signal also bearing information can still be effectively localized. A complex signal comprising merely a narrow band alarm signal and a verbal information signal is not suitable, since neither component of such a signal is effectively localized.

Nevertheless, the invention does not preclude the additional presence of a conventional narrow band alarm signal, whether operated in conjunction with or separately from the device of the invention, and whether the alarm signal is audio or visual or some combination. For example, an additional audio alarm signal may be generated, for example comprising narrow band sound such as a conventional siren or bell. This may be generated separately and at another location from the device of the invention, generally co-located with but generated separately from the device of the invention, or co-operably generated in the device as part of a complex signal which also includes at least the locating sound signal and information sound signal hereinabove described.

As a narrow band audio alarm signal can be isolated reasonably effectively by an individual from a broad band locating sound and a vocal information sound as above described, such an alarm signal could be generated simultaneously with the signal pattern of the invention. Alternatively, an alarm signal could be co-ordinated to be sounded sequentially as part of an ordered combined signal pattern.

In a possible embodiment of the invention the device is further provided with visual display means to provide a visual cue to reinforce the message of the device. The visual cue may reinforce any alarm and/or reinforce the verbal information signal for example, the visual cue may comprise words or symbols which repeat, reinforce, clarify or otherwise complement the verbal message, directional markers, illumination or the like.

In a possible embodiment of the invention the device is further provided with a cut-out means which disables the signal after a preselected interval of time and/or in certain conditions. The cut-out means may be activated once a heat/chemical/radiation detector, or other detector, associated with the device records a preselected level of a corresponding indicator such as smoke, chemicals, radiation etc. This will ensure that individuals are not directed via an exit that has become unsafe.

The invention includes a sound generating means arranged to receive an audio signal pattern as described with reference to the above aspects.

The invention includes a signal generating means adapted to produce an audio signal or an audio signal pattern or a sound as described by the above aspects.

The invention includes a signal storage means adapted to carry an audio signal or signal pattern signal as described by the above aspects.

According to a second aspect of the invention there is provided a complex locatable sound signal comprising sequentially a locating sound comprising broad band sound and an information sound comprising verbal information.

In particular the complex signal comprises as hereinabove described a locating signal made up of 3 to 5 discrete bursts of locating sound, a signal separation pause, and a verbal information signal. The two signals are preferably generated from the same directional source.

In a further embodiment, a complex signal comprises successive cycles of the above signal successively generated and each separated by a cycle separation pause.

Further preferred features of this embodiment will be understood from the foregoing.

According to a third aspect of the invention there is provided a method of enabling an individual to locate and orientate himself in an environment, especially in an emergency for example to identify and be guided to safe exit routes. The method comprises generating a first, locating sound signal comprising broad band sound; closely successively thereafter but after a discrete intervening pause generating a second, information sound signal comprising verbal information; optionally successively but after a further discrete intervening pause repeating the foregoing.

As previously, the first signal preferably comprises 3 to 5 discrete bursts of locating sound; the second signal may be one or several words, in the latter case separated by short further pauses. The two signals are preferably generated from the same or generally co-located sources, or are generated such as to be perceived aurally to have such a generally common source by a hearer.

According to a fourth aspect of the invention there is provided a system for guiding an individual within an environment, and in particular an emergency evacuation system, comprising at least one and preferably a plurality of suitably placed devices in accordance with the first aspect of the invention, and/or means to generate a signal in accordance with the second or third aspect of the invention so arrayed that when activated the locating signal enables an individual to locate the source of the signal, the information signal gives information concerning that location, and the two signals together assist the individual in the navigation of the environment.

This system represents a significant application of the invention, in use in a guidance system and in particular in an evacuation system. In contrast to the referenced prior art, where the complex locating signal can be located, but an individual does not know how to react to such a locating signal without further training, the complex signal of the invention informs the individual what action to take. The complex signal is localizable because of the presence of the locating signal. However, the individual may also be informed what action to take by the information signal, which will typically for example guide the individual towards the source of the signal.

Other preferred features of subsequent aspects of the invention will be understood by analogy with the more detailed description of the first aspect.

The invention will now be described by way of example only in order that the reader may more readily understand the nature of the device, system and signal pattern. However, it is not intended that the scope of the invention should be limited by the following information which is provided by way of exemplification only.

FIG. 1 shows a general representation of an audio signal cycle in accordance with the invention.

FIG. 1 refers to a suitable complex signal cycle in accordance with the invention, which in the example is adapted to assist in the evacuation of an individual from a relatively large enclosed space such as a basement, tunnel or the like. Signal perimeters are likely to vary with auditory environment, in particular optimal pulse patterns and lengths.

In the example, the complex signal comprises a locating sound signal made up of three 225 ms broad band pulses separated by 200 ms inter pulse intervals. A 400 to 450 ms pause precedes the recorded or synthesised voice message. After a further 550 ms pause after the voice message the whole cycle is repeated.

The purpose of the voice message is to give information about the sound source which the broad band pulse has enabled the individual to localize. For many practical purposes this will be an information message intended to guide the individual towards the sound source, though for other applications other messages can be envisaged. In the present instance, the purpose of the voice message is to guide the individual towards an exit which the locating sound has enabled the individual to localize.

The voice message therefore comprises a small number of discreet words intending to convey this message. In the example, the voice message is "exit here", although similar messages such as "this way", "safe exit", "way out", can readily be envisaged, and of course the principle is not limited by language.

Analysis of the voice message, and the ability to comprehend it, is critical. In this regard it is found that the exact length of words is not critical, but clarity is essential. Accordingly a discrete space is inserted between each word of, in this example, between 350 to 450 ms. In the example the two words take around 450 to 500 ms. This is illustrated in Inset A Referring to Inset B, there is shown a locating audio signal burst comprising an amplitude/time plot for a suitable 225 ms burst of broad band sound, having a 5 ms leading edge (2) in which the broad band sound signal in the range 40 Hz to 20 kHz undergoes an amplitude transition from a minimum amplitude level in which the signal produces an inaudible, or barely audible sound or no sound to maximum amplitude level, 215 ms at the maximum amplitude level (1), and a 5 ms trailing edge (3), in which the signal undergoes transition from its maximum level to its minimum level.

The locating audio signal burst of Inset B is intended to allow location of the sound generator by a listener. The listener is then able to be guided with respect to this location by very simple voice instructions.

Although the invention has been described by reference to a single sound generating means the invention also comprises a system where a plurality of sound generating means are provided and either first and second sound generating means are adapted to emit first and second sounds i.e. locating sounds and information sounds respectively; or alternatively a system where a plurality of sound generating means are adapted to emit both said first and second sounds in a controlled manner so that the nature and duration of said sounds can be predetermined and the interaction of each of one or more of said devices may be controlled so as to provide for a preselected sound pattern which represents the totality of the sound emitted from all or selected ones of said devices.

The invention thus provides for a sound device which is not merely locatable but gives an individual who has effected that location actionable information about what to do with respect to the location without the prior training or the need to make inferences about exit routes or the like which is necessary if a locatable signal only is provided.

The invention claimed is:

1. An alarm device which is adapted to emit sequentially a locating broadband sound signal and an alerting sound signal, characterized in that:

said locating broadband sound signal precedes said alerting sound signal and said locating broadband sound signal comprises a plurality of successive pulses of broadband sound (B1, B2, B3), wherein the alerting sound signal comprises verbal information in the form of at least one spoken word (V) that guides individual listeners towards the device, and the locating sound pulses include elements spread across a substantial part of the breadth of the range of frequencies between 200 and 1000 Hz and between 3000 and 12000 Hz.

2. A device in accordance with claim 1 adapted to repeat a signal cycle successively, said signal cycle comprising said locating broadband sound signal and said alerting sound signal.

3. A device in accordance with claim 1 wherein the plurality of successive pulses of broadband sound are separated by an intervening pause.

4. A device in accordance with claim 1 wherein the locating broadband sound signal and the alerting sound signal are separated by an intervening pause.

5. A device in accordance with claim 1 wherein the at least one spoken word is transmitted as a discrete signal burst.

6. A method of enabling an individual to locate and orientate himself in an environment, the method comprising generating a locating broadband sound signal and an alerting sound signal, characterized in that said locating broadband sound signal precedes said alerting sound signal, and in that said alerting sound signal comprises verbal information in the form of at least one spoken word that guides said individual towards a sound generator device.

7. A system for guiding an individual within an environment, comprising at least one device in accordance with claim 1 so arrayed that when activated the locating signal enables an individual to locate the source of the signal, the alerting signal gives information concerning that location, and the two signals together assist the individual in the navigation of the environment.

8. A device in accordance with claim 1 further adapted to emit an additional audio alarm signal.

9. A device in accordance with claim 1 wherein said alarm device defines a common source for said locating broadband sound signal and said alerting sound signal for guiding the individual listeners towards said alarm device.

10. A method in accordance with claim 6 wherein said locating broadband sound signal and said alerting sound signal are generated such as to be perceived aurally to have a generally common source by said individual.

* * * * *